US008727822B2

(12) United States Patent
Ozkul

(10) Patent No.: US 8,727,822 B2
(45) Date of Patent: May 20, 2014

(54) SELECTABLE DESTINATION UNDERWATER TOWED CABLE FERRY SYSTEM AND GUIDANCE MECHANISM

(76) Inventor: Tarik Ozkul, Istanbul (TR)

( * ) Notice: Subject to any disclaimer, the term of this patent is extended or adjusted under 35 U.S.C. 154(b) by 0 days.

(21) Appl. No.: 13/320,920

(22) PCT Filed: Dec. 5, 2010

(86) PCT No.: PCT/IB2010/055586

§ 371 (c)(1),
(2), (4) Date: Nov. 17, 2011

(87) PCT Pub. No.: WO2011/141778

PCT Pub. Date: Nov. 17, 2011

(65) Prior Publication Data

US 2012/0132126 A1 May 31, 2012

(51) Int. Cl.
*B63H 19/08* (2006.01)

(52) U.S. Cl.
USPC ..... 440/35

(58) Field of Classification Search
USPC ..... 440/33, 34, 35; 701/19, 20, 21
See application file for complete search history.

(56) References Cited

U.S. PATENT DOCUMENTS

| | | | | | |
|---|---|---|---|---|---|
| 185,854 | A | * | 1/1877 | Cooke | 114/60 |
| 313,920 | A | * | 3/1885 | Cooke | 440/35 |
| 381,675 | A | * | 4/1888 | Cassleman | 440/34 |
| 633,294 | A | * | 9/1899 | Perew | 105/29.1 |
| 1,075,111 | A | * | 10/1913 | Koss | 440/35 |
| 2,743,697 | A | | 5/1956 | Cooper et al. | |
| 2,997,004 | A | * | 8/1961 | Roseubaum et al. | 104/130.11 |
| 3,604,389 | A | * | 9/1971 | Roberts et al. | 440/34 |
| 3,782,292 | A | * | 1/1974 | Metcalf | 104/130.01 |
| 3,785,326 | A | * | 1/1974 | Mullerheim | 440/34 |
| 4,094,252 | A | * | 6/1978 | Pater et al. | 104/130.01 |
| 7,028,955 | B2 | | 4/2006 | Young et al. | |
| 7,302,319 | B2 | * | 11/2007 | Wu | 701/19 |
| 8,215,591 | B2 | * | 7/2012 | Roop | 246/415 R |
| 2010/0233918 | A1 | | 9/2010 | Askgaard | |
| 2011/0114431 | A1 | * | 5/2011 | Crouse | 191/2 |

FOREIGN PATENT DOCUMENTS

| | | | |
|---|---|---|---|
| JP | 53124893 | | 10/1978 |
| JP | 53124893 | A * | 10/1978 |
| JP | 01063468 | A * | 3/1989 |

* cited by examiner

*Primary Examiner* — Stephen Avila
*Assistant Examiner* — Andrew Polay
(74) *Attorney, Agent, or Firm* — Cesari and McKenna, LLP

(57) ABSTRACT

A multiple destination cable ferry system where a marine vessel is towed by an underwater sled into its final destination over underwater tracks and transfer switches. The system is designed to be under total computer control in such a way that the towed vessel can be delivered to its final destination without requiring any human intervention aboard the vessel.

13 Claims, 9 Drawing Sheets

A

B

SELECTABLE DESTINATION UNDERWATER TOWED CABLE FERRY SYSTEM AND GUIDANCE MECHANISM

CROSS REFERENCE TO RELATED APPLICATIONS

This application is the national stage entry under 35 USC 371 for PCT/IB2010/055586, filed Dec. 5, 2010. The contents of the foregoing application is incorporated herein by reference.

FIELD

This application is related to the field of cable ferries, more specifically to marine propulsion, steering and dynamic anchoring.

BACKGROUND

Cable ferries are vehicles used for crossing rivers and canals using cable system, which is connected to both sides of the shore. Cable system is usually a steel cable and may be located either under water or above water. Cable ferries are well known since middle ages and used by many civilizations. Since cable ferries may be towed by pulling the cable from either side of the shore, the ship or the barge do not need to be powered on its own. Since the route of the cable ferry is necessarily determined by the cable that tows the boat, its operation is not affected by weather elements like fog, wind or river currents. In some cable ferry applications the boat may have its own engine power to pull the cable in order to provide the necessary propulsion toward the destination. The mentioned examples of related art are intended to be illustrative rather than exclusive. Current cable ferry designs are well known to those who are skilled in art.

As the environmental consciousness of the world increases, there are attempts to utilize cable ferries more frequently in environmentally friendly ways. Askgaard, in his publication US2010/0233918 A1 teaches a way of using electrically operated flywheel for operating cable ferry for carrying people and vehicles for short distance transportation.

This application intends to increase versatility of the cable ferry by providing multiple destinations as well as computer controlled operation.

SUMMARY

This invention is about cable ferry system with multiple destinations which can be used to tow a marine vessel to its final destination through a system of guided cable, chain or tracks through electronically controlled switch mechanisms. Unlike a classical cable ferry, which is dragged into its final destination by a single cable, this invention uses multiple cable systems or tracks and different propulsion mechanisms to lead the cable ferry into one of the multiple destinations selected. The invention teaches different embodiments of achieving this purpose. In one of the embodiments of the invention, the cable ferry is towed by an underwater sled to its final destination where the sled is switched from one track to another under electronic guidance. In another embodiment of the invention, the underwater sled can be attached to a moving cable or chain mechanism, which is being pulled by other means.

The invention also teaches the method of transferring underwater sled from one track to another, which is necessary in order to direct the sled into different destinations. Unlike a railroad track which works in a two dimensional plane, the invention teaches a mechanism that works in three-dimensional space which can also handle tracks that crosses each other's path. The system is designed to operate under computer control, which not only controls the switches at suitable locations but also keeps track of location of other cable ferries in order to facilitate trouble free crossing at switch points. The tracks are allowed to cross each other's path and the computer keeps track of location of all towed cable ferries. The speed of the sled is periodically adjusted in order to avoid colliding with other sleds towing other cable ferries.

The invented system provides an environmentally friendly way of transportation in sea since the propulsion force of the sled may be provided by wind turbines placed alongside the cable ferry routes. Another notable advantage of the system may be the unmanned operation of the cable ferry. Purpose built cable ferries designed for transporting goods can be sent to desired destination without human controller on board without being affected by weather conditions.

The tracks or the chains that provide the propulsion for the cable ferry are submerged well below the underwater depth of ships that sail the sea in order not to interfere with the usual self-propelled marine traffic. The invention teaches different methods for laying tracks in shallow as well as deep-sea locations.

DESCRIPTION

Figure 1:
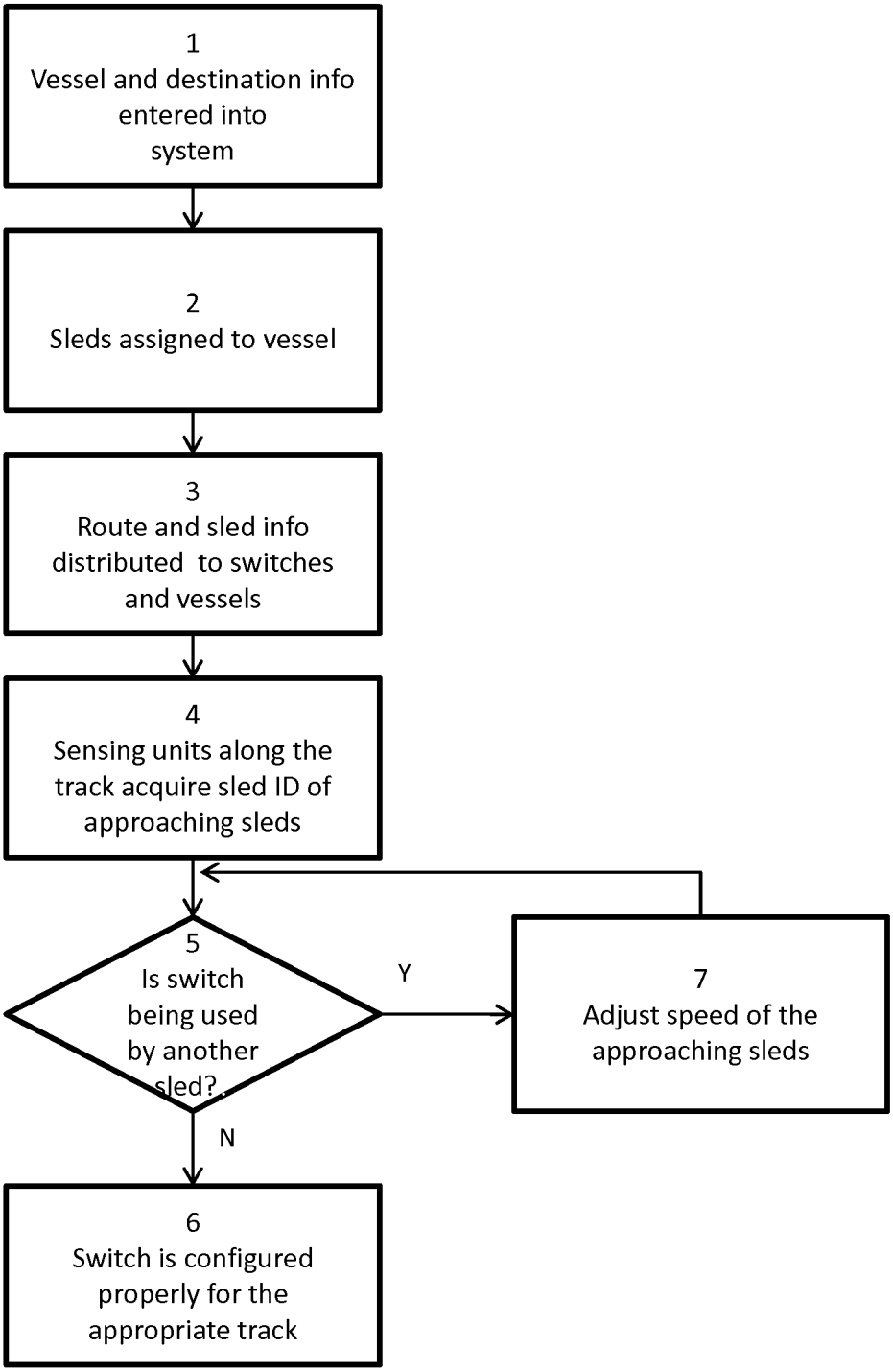
FIG. 1 shows the flow chart of the operation of the invention.

Cable ferry is a simple and cost effective solution for crossing short straits of water. Since cable ferry does not need an engine on board for propulsion, the cost of the vessel is minimal. The navigation of the vessel is also not a problem since it gets dragged to its final destination; as a result usual whether elements like fog or currents do not affect operation of the vehicle. Another added advantage is in the efficiency of the cable ferry operation. Self propelled ships use propellers to turn engine motive power into trust. It is well known to the people skilled in the art of marine propulsion that there are many different types of losses when rotational movement of engine is converted into trust by way of propellers. Dragging the vessel by cable eliminates some of the energy loses caused by the propeller. Of course cable ferry suffers from different types of losses which is mainly caused by dragging a heavy cable, but overall arrangement is much more environmentally friendly since the power source of the cable ferry system do not need to be on the vessel. Motive power for cable ferry system can be stationery on the shore and can be provided by electrical energy which is clean and may be provided by renewable means like wind turbines.

The traditional cable ferry suffers from the fact that it is designed for short straights and travels from one point to another. In this invention what is proposed is a system which enlarges the scope of cable ferry into a digitally controlled highway for maritime traffic where marine vessels are dragged into their destinations by underwater track system.

The subject of invention is a cable ferry guidance system where a ferry is towed into its final destination by an underwater mechanism comprising cables, chains, tracks and digitally controlled switch mechanisms. The system retains all the advantages of the classical cable ferry but increases its versatility by making it possible to go into different destinations. Energy source for the system can come from renewable energy sources like wind turbines placed along the route of the cable ferry. The cable ferry used in the system can be a vessel floating over water or it may be a vessel submerged underwater. The system is applicable to any size maritime waters including sea, river or lake.

The cable ferry, which will be referred as "vessel" from now on, is towed by one or more sleds running on underwater tracks. In one embodiment of the system, the vessel is coupled to two sleds via cables where one of the sleds is located in front of the vessel and the other one is located at the back of the vessel. The front sled tows the vessel forward and the back sled is used for stopping the vessel when needed as well as preventing the vessel drifting away from the path of the track underneath. The two sleds work in unison to accelerate, steer and stop the vessel as the journey requires. The sleds are completely submerged underwater and placed over special tracks, which are anchored to the bottom of the sea. The underwater tracks where the sleds are running are placed well below the hull depth of maritime traffic in the region and normally do not interfere with the self-propelled maritime vessels operating in the vicinity. The depth of the underwater tracks is maintained at a specific depth regardless of how deep the waters along the path of cable ferry. Depending on how deep the seabed is, the underwater tracks are either laid on the seabed directly or attached to pillars raised on the seabed or anchored by chains to the seabed. The exact attachment mechanism depends on the depth of the sea. In shallow waters, it may be sufficient to place the tracks on pillars or on the seabed directly, whereas in deep waters it may be necessary to anchor the tracks to the bottom of the sea. The tracks are designed to be buoyant and have tendency to rise to the surface. As a result, the tracks needs be anchored to the seabed in order to avoid them going up to the surface of the water. In locations where the water is too deep, the length of the anchoring chain maintains the track at a specific depth. This fact is especially important for the manufacturability of the track system along the deep portions of the sea since tracks can be laid by simply placing weighs along the track and connecting tracks to the weights with suitable length anchor weights.

The sleds are designed to be physically engaged and attached to the underwater track. The sleds may also contain prime mover inside which may be electrically, hydraulically or pneumatically powered in order to provide the motive force. The power to the sled can be provided either by the towed vessel itself or by external means like stationery power generators in the vicinity through the tracks.

In order to direct the towed vessel into different destinations it is necessary to switch the sleds from one track to another as needed. This operation is achieved by electrically, pneumatically or hydraulically activated switch mechanism, which is controlled digitally under computer control. As the sled towing the vessel approaches to a switch location, the sled is interrogated by number of electronic sensing units placed along the track, which acquire the ID number of the approaching sled. Underwater communication methods that can be used for interrogation of the approaching sleds can be acoustical, ultrasonic or electromagnetic and it is well known to those who are skilled in this art. Since the destination information of the vessel is associated with the sled ID, the switch controller switches the incoming track to the proper outgoing track well before the sled arrives at the switch junction. After both bow and stern side sleds pass through the switching junction, the switch is ready to provide navigation to another incoming sled pair.

The switch mechanism is also designed to handle tracks that may cross each other's path. The electronic sensors inform the computer system that keeps track of all sleds operating in the vicinity of the switch and adjust the speed of the approaching sleds as required so that different pairs of sleds do not attempt to cross the switch at the same time.

The operation of the system will now be explained using figures.

FIG. 1 shows the block diagram of the operation of the system. In block 1, vessel and destination information is entered into the system. In block 2, vessel is mated with sleds and sled ID's are associated with the vessel information including destination. In block 3, the sled and route information is distributed to the switches and other vessels through networking means. Block 4 shows the actions done as the sled moves forward on the track and approaches to a switch position. As the sled starts moving, it is interrogated by sensing units placed alongside the track and the switches are configured appropriately for the desired destination track. If the switch is currently blocked by another pair of sleds crossing the track, the information is provided to the other sled pair approaching the switch in order for them to slow down or stop their movement. This process is shown in decision block 5. If switch is not currently being crossed by another sled pair, the actuators inside the switch are instructed to move into the appropriate position in block 6. If the switch is occupied by other sleds crossing the switch, the incoming sled speed is adjusted by the system in order to operate in the most efficient manner which is shown in block 7.

Figure 2:
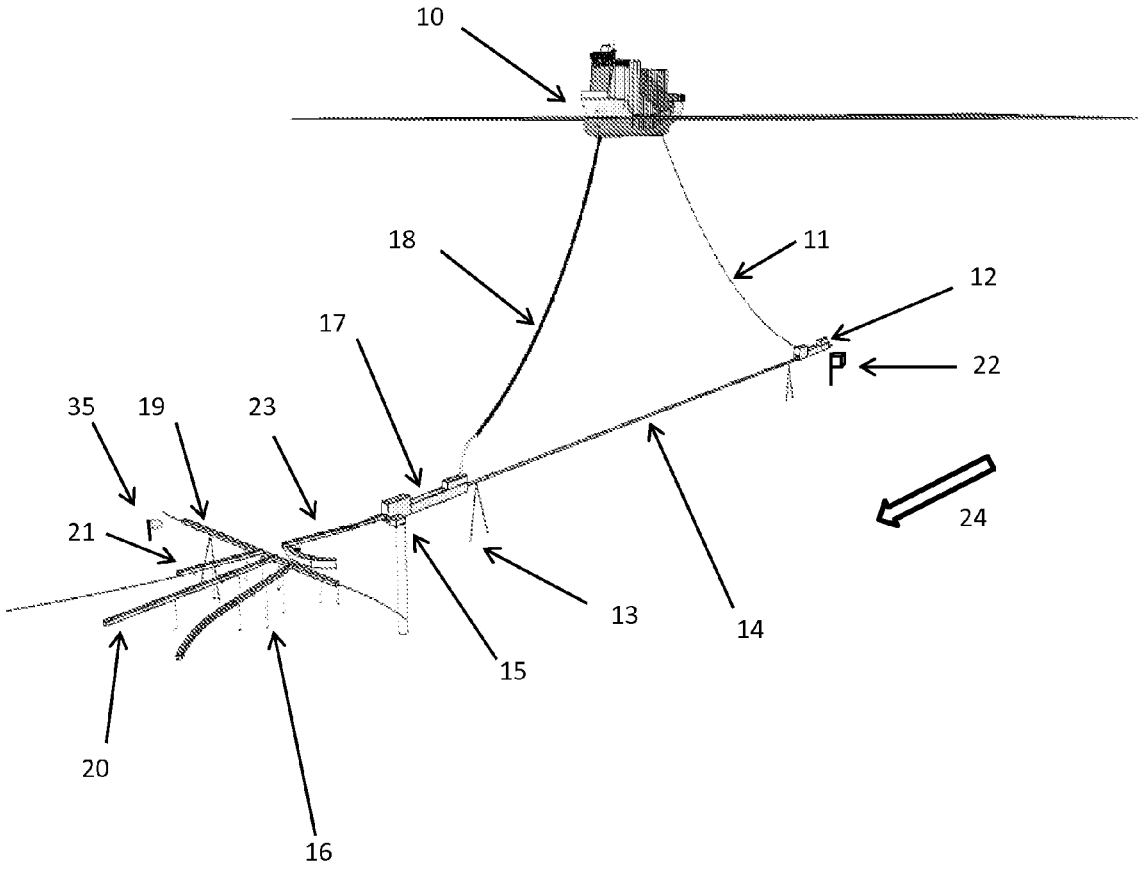
FIG. 2 shows the overall outlook of the system.

FIG. 2 shows the perspective appearance of the overall system where vessel 10 is attached to bow sled 17 which is connected to the front side of the vessel and stern sled 12 which is connected to the aft part of the vessel through cables 18 and 11. Both sleds 12 and 17 are on track 14 which may be placed on pillars like 16 or anchored to sea bed by chains 13. As the sleds 12 and 17 move over the track 14, the position and sled ID's are interrogated by sensing units 22 and 15 positioned alongside the track 14. Switch mechanism 23 directs the sled 17 approaching from the direction of 24 to track 21. The system accepts tracks coming from other directions like 19 to cross tracks like 14. Track 19 also has sensing units like 35 to sense the passing sleds.

Figure 3:
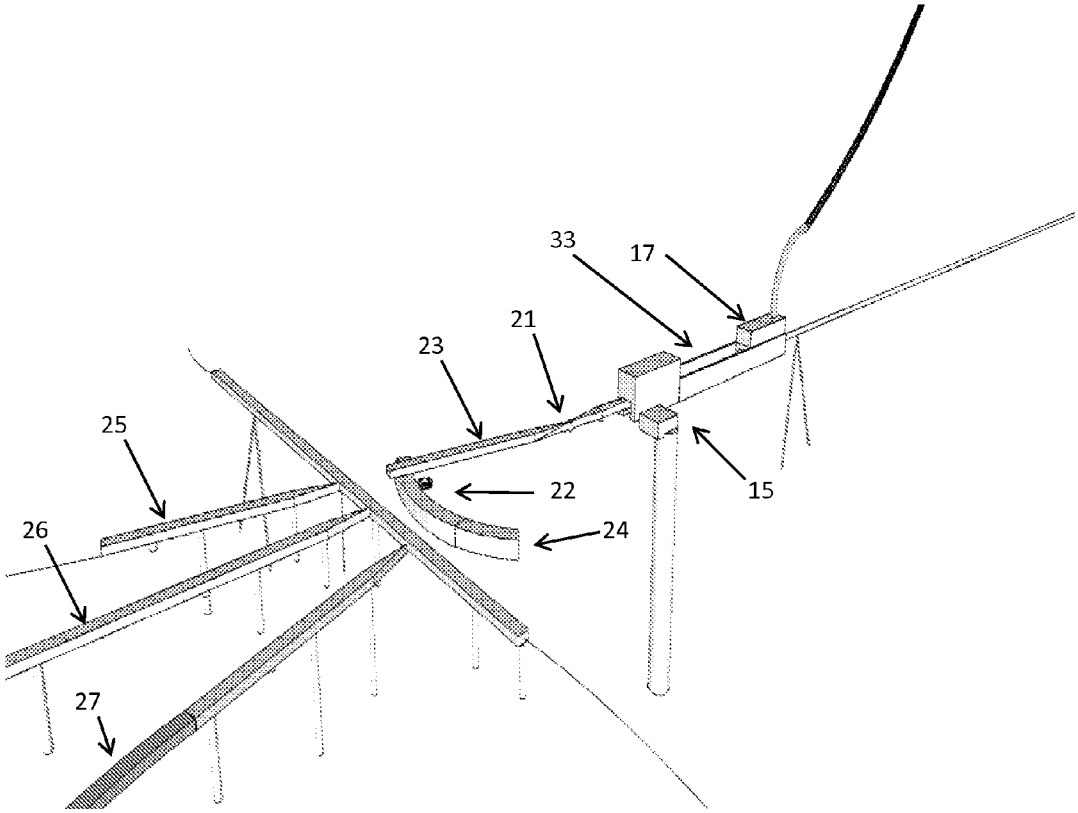
FIG. 3 shows the details of the switch system, which switches tracks.

FIG. 3 shows the details of the switch mechanism of a preferred embodiment where the incoming sled 17 is interrogated by the sensing unit 15. Guide rail 23 is hinged at the position 21 and free to rate sideways with respect to the hinged pivot point 21 over the support assembly 24. The actuation movement of actuator 22, the guide rail 23 is aligned and locked by either track 25, track 26, or track 27. Sensing unit 35 placed over the output track used to confirm when sled enters and leaves the right track. The mid portion 33 of the sled 17 is made from semi-flexible material which can conform to the shape of the track as the sled is running over the track. As a result of this compliance built into the sled, the sled can follow the guide rail 23 which is hinged at point 21.

Figure 4:
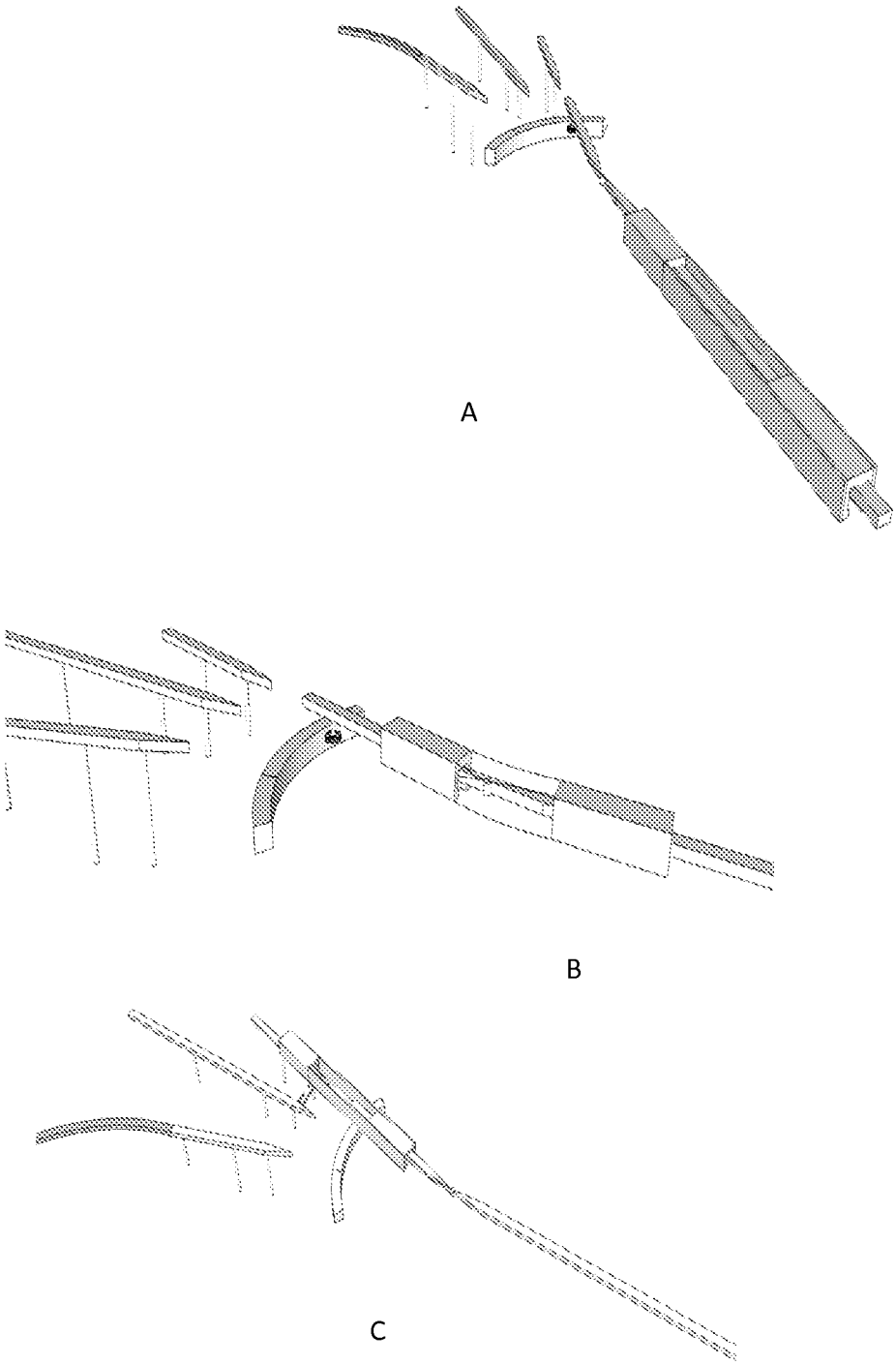
FIG. 4 shows one particular embodiment of the switch as a sled go through the switch assembly.

FIG. 4 shows how sled enters and leaves the switch in the preferred embodiment. FIG. 4A shows instant when the sled is approaching the guide rails of the switch. In FIG. 4B the sled mechanism is passing over the hinged portion of the switch and complies with the shape of the guide rail. FIG. 4C shows the sled at the end position of the switch as it leaves the switch mechanism.

Figure 5:
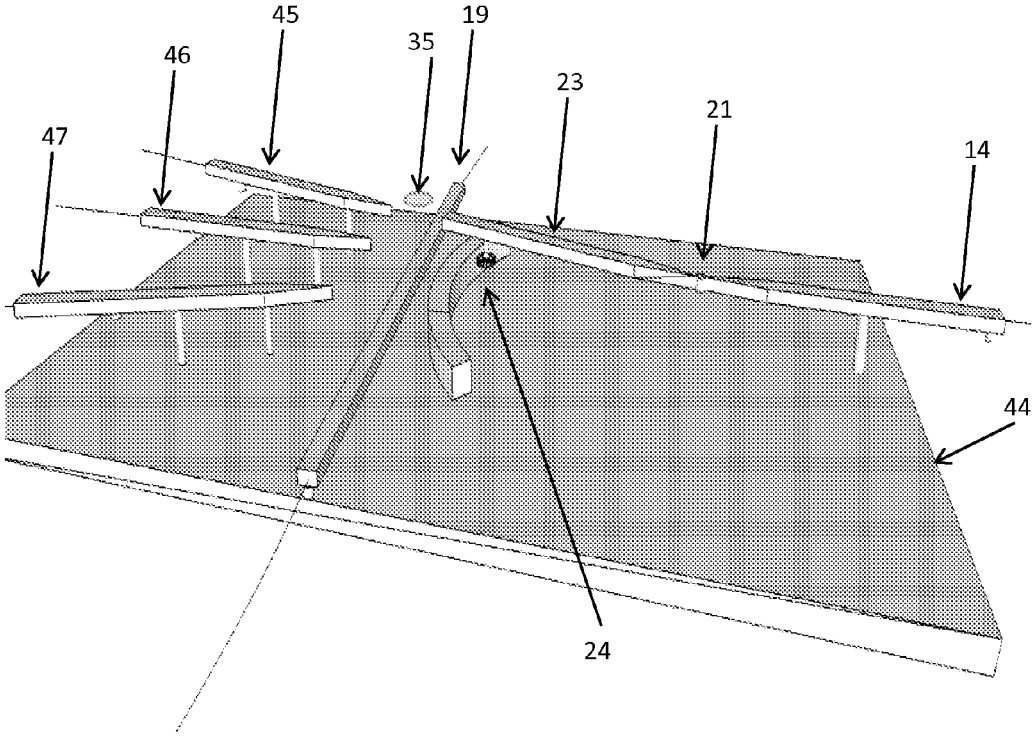
FIG. 5 shows a preferred embodiment of the switch system.

FIG. 5 shows another view of the preferred embodiment of the switch mechanism where the incoming track 14, guide rail 23, actuator mechanism 24, outgoing tracks 45, 46, 47 and crossing track 19 are attached to a single rigid platform 44. The height of the crossing track 19 is lower than the height of the incoming track 14 and outgoing tracks 45, 46, 47 in such a way that passing sleds in either track 14 or 19 can do so without snagging on the other tracks. Crossing track 19 also has sensing input 35 to detect passing sleds.

Figure 6:
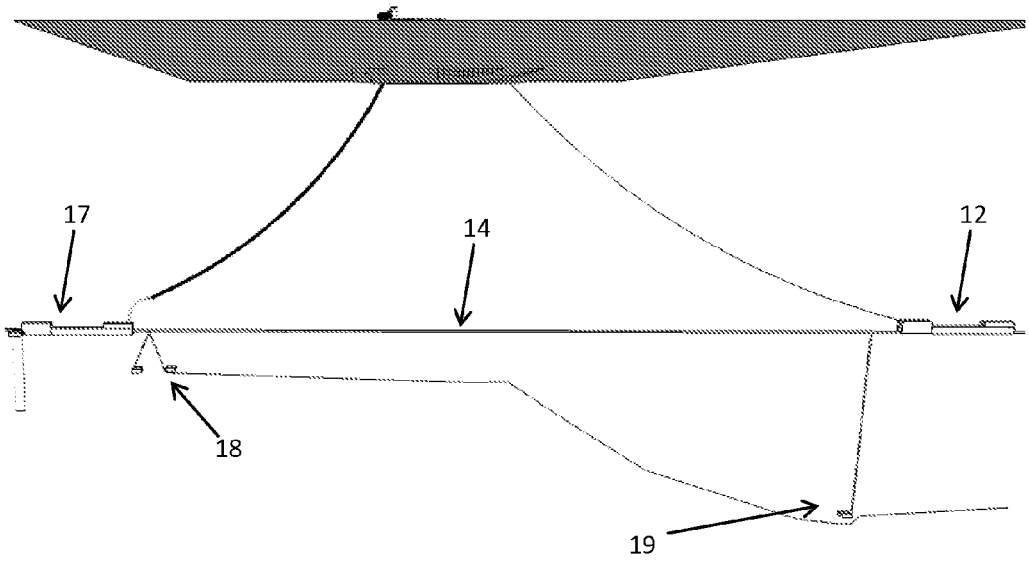
FIG. 6 shows an embodiment of the invention where the tracks are anchored to an uneven sea bed.

FIG. 6 shows an embodiment of the system where the sea bed has uneven depth along the path of the track and how the tracks are attached to sea bed in deep locations. In locations where the sea level is not too deep, short length anchoring chains like 18 attach the track 14 to the sea bed. In locations like 19 where the sea level is deep, the anchoring chain length is longer to compensate for the difference in depth. Track 14 is designed to be buoyant, so it needs to be anchored to sea bed in order to keep the tracks suspended in water.

Figure 7:
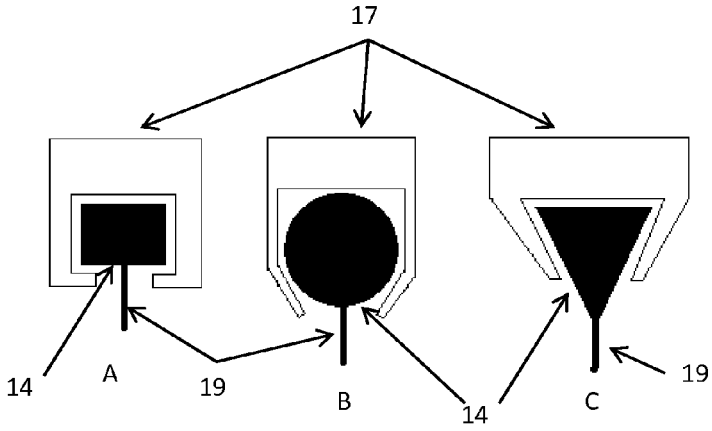
FIG. 7 shows cross section of tracks and sleds for different embodiments of the sled and track.

FIG. 7 shows several embodiments of the track cross sections and the sleds. FIG. 7 A shows a track with rectangular cross section 14, and the sled assembly 17. Track is attached to anchor chain 19 from the bottom in such a way that movement of the sled along the track is not hindered by the anchor connections. FIGS. 7B and 7C shows tracks with circular and triangular cross sections and the suitable sled assembly for them.

Figure 8:
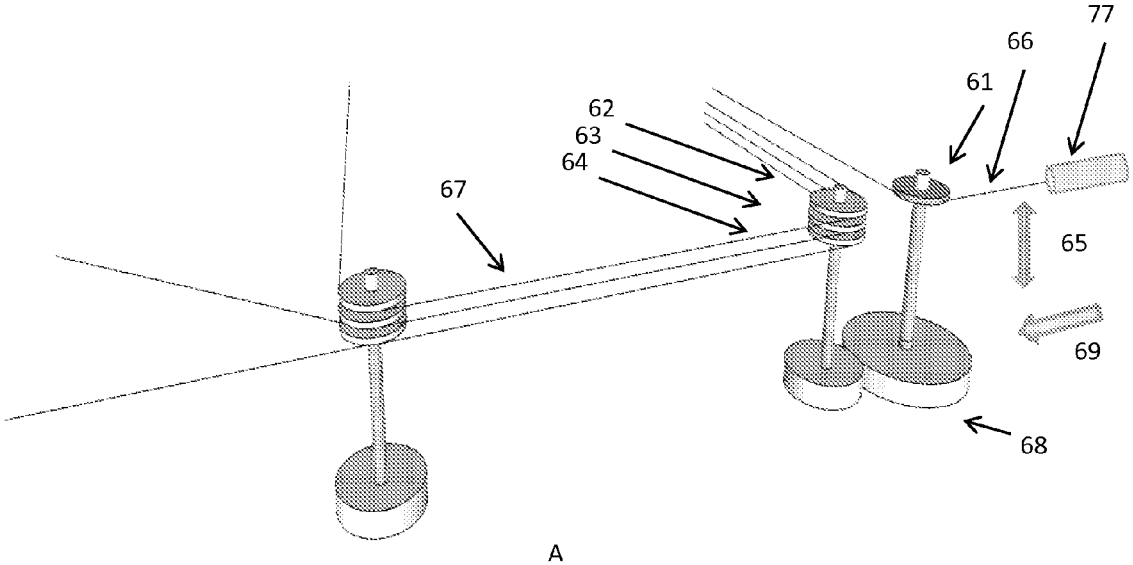
FIG. 8 shows an embodiment of track system where tracks are made out of cables and a suitable sled arrangement for this embodiment.
Figure 8:
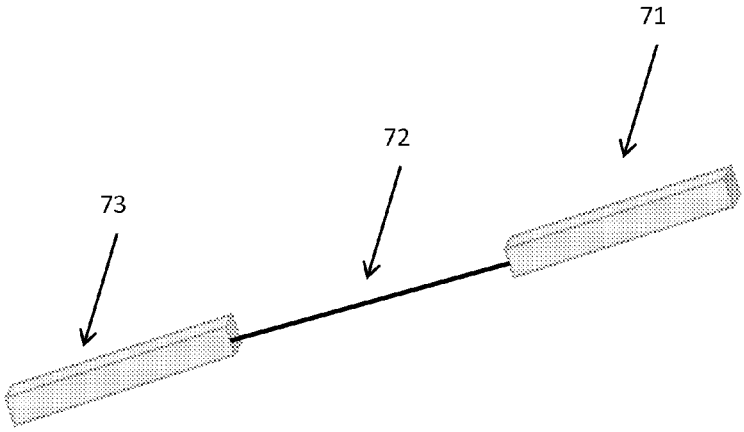

FIG. 8A shows another embodiment of the track and switch system where the tracks are made of cable that move continuously and sleds get attached to moving tracks. In this embodiment, the track is cable 66 which is being pulled by pulley 61 in the direction of 69 which is powered by a prime mover inside base 68. The pulley 61 is movable up and down along the axis of rotation shown as 65. The actuator inside base 68 aligns pulley 61 with the desired pulley which may be 62, 63 or 64. Once the pulleys are aligned, the sled coming from the incoming track 66 is transferred to outgoing track 67. In this embodiment the sled has no prime mover inside and simply gets attached to the moving cable assembly to tow the attached vessel. The sled gets clamped to the cable 66 and approach the switch assembly from the direction of 69. Incoming sled 77 is guided by pulley 61 which is aligned with one of the output tracks guided by pulleys 62, 63 or 64. In the figure pulley 61 is aligned with pulley 62, so the coming sled 77 gets transferred to track 67. FIG. 8B shows the sled for this particular embodiment of the design. The sled has two clamping parts 71 and 73 connected by a semi rigid part 72. When sled gets attached to track which is in the form of cable, both clamps 71 and 73 are activated and they clamp to the cable. As the sled moves through the switch 73 releases the cable 66 while 71 is still clamping to cable 66. When sled is sufficiently advanced through the switch, the clamp 73 clamps the cable 67 and clamp 71 releases cable 66.

Figure 9:
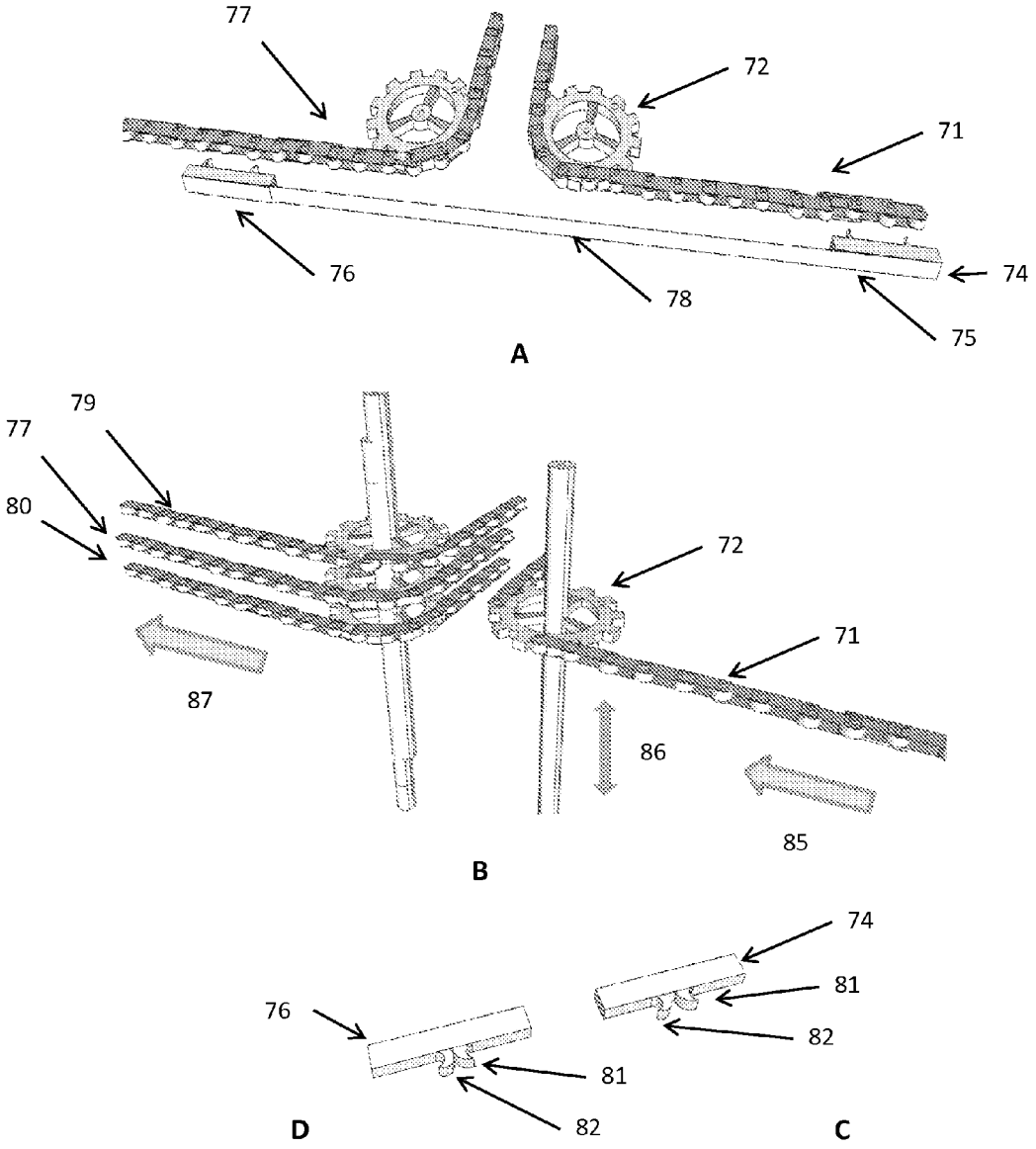
FIG. 9 shows an embodiment of track system where tracks are made out of chains and a suitable sled arrangement for this embodiment.

FIG. 9 shows yet another embodiment of the system where tracks appear as chains. FIG. 9A shows the track and the sled system where the chain 71 works as the track for the system and moved by gear 72. The sled assembly is shown as 74 and has two clamping parts 75 and 76. Rear clamp 75 and front clamp 76 are connected through semi rigid connecting part 78 which can bend and comply as it moves along the tracks. FIG. 9B shows the mechanism of alignment for this embodiment of the switch. Gear 72 is free to move vertically along the direction of 86 and gets aligned with one of the outgoing tracks 79, 77 or 80. The sled gets clamped to moving chain by using special tooth on the sled. FIG. 9C and FIG. 9D show the details of the clamp mechanism. FIG. 9C shows the clamped version of the sled where the distance between tooth 81 and 82 is enlarged and unit gets engaged with the chain. FIG. 9D shows the released version of the embodiment where the distance between tooth 81 and 82 is reduced and assembly gets detached from the chain.

Figure 10:
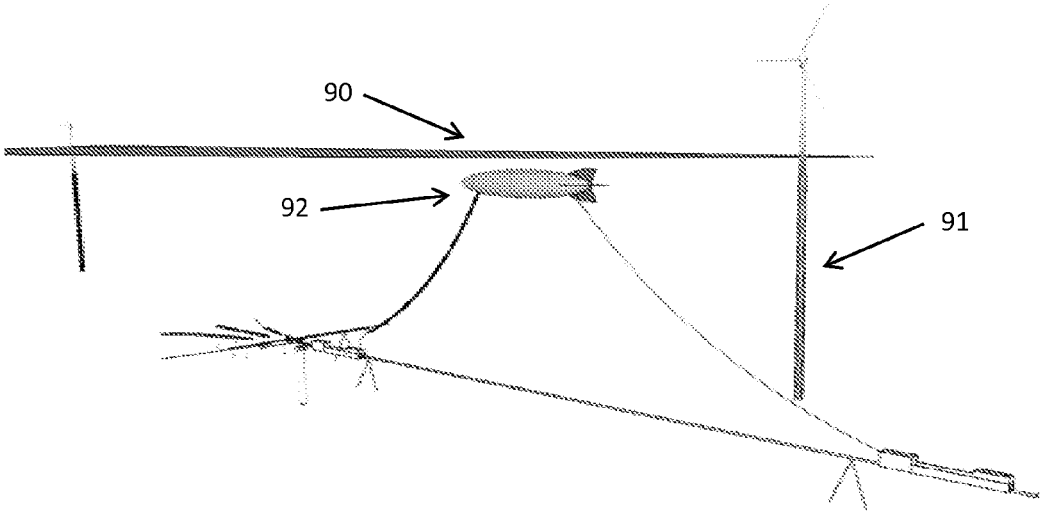
FIG. 10 shows an environmentally friendly embodiment of the invention which tows submerged containers.

FIG. 10 shows an environmentally friendly embodiment of the invention where a streamlined cargo container is towed under the water surface without being affected by the weather elements or the wave conditions. An unmanned cargo container 92 is towed right below the water line 90 by the sled arrangement of the invention. The system may be powered by wind turbines 91 erected along the path of the tracks.

The invention claimed is:

1. An apparatus comprising:

one or more underwater sleds coupled to a water-borne vehicle, the one or more underwater sleds that tow the water-borne vehicle along an underwater track that includes at least an incoming track and a crossing track positioned to cross over the incoming track;

a sensing unit positioned alongside the underwater track, the sensing unit that:

determines identification information associated with the one or more underwater sleds, determines whether one or more other sleds, associated with other identification information, are on the crossing track and utilizing the switch when the one or more underwater sleds coupled to the water-borne vehicle are within a predetermined distance of the switch mechanism;

in response to determining that one or more other underwater sleds are not on the crossing track and not utilizing the switch, a switch mechanism that directs a guide rail towards a selected outgoing track of a plurality of outgoing tracks based on the identification information associated with the one or more underwater sleds, wherein the guide rail is positioned between the incoming track and the plurality of outgoing tracks and the one or more underwater sleds that tow the water-borne vehicle over the guide rail and the selected outgoing track in response to the switch mechanism directing the guide rail towards the selected outgoing track; and in response to determining that the one or more other underwater sleds are on the crossing track and utilizing the switch, the one or more underwater sleds that reduce a speed of the one or more underwater sleds on the incoming track.

2. The apparatus of claim 1, further comprising a crossing track having a relative height level that is lower than a level of the incoming track and the plurality of outgoing tracks.

3. The apparatus of claim 1, wherein a connection between the incoming track and the plurality of outgoing tracks is achieved through changing position and aligning the guide rail with one of the outgoing tracks, wherein actuation of the guide rail is achieved by electrical means under digital control.

4. The apparatus of claim 3, wherein the switch mechanism to respond to detection of the one or more underwater sleds approaching the incoming track before the one or more underwater sleds arrive at the switch mechanism.

5. The apparatus of claim 1, further comprising a crossing track that crosses a path defined by the incoming track, the guide rail, and the plurality of outgoing tracks.

6. The apparatus of claim 1, wherein the incoming track is buoyant.

7. The apparatus of claim 6, further comprising an anchor and an anchoring chain extending from the anchor to the underwater track, thereby maintaining the underwater track at a specific depth.

8. The apparatus of claim 1, wherein a connection between the incoming track and the plurality of outgoing tracks is achieved through changing position and aligning the guide rail with one of the plurality of outgoing tracks, wherein actuation of the guide rail is achieved by pneumatic means under digital control.

9. The apparatus of claim 1, wherein a connection between the incoming track and the plurality of outgoing tracks is achieved through changing position and aligning the guide rail with one of the plurality of outgoing tracks, wherein actuation of the guide rail is achieved by hydraulic means under digital control.

10. The apparatus of claim 1, wherein the one or more underwater sleds is self-propelled.

11. The apparatus of claim 1, wherein the one or more underwater sleds is propelled by engaging a moving chain.

12. The apparatus of claim 11, wherein the moving chain is powered at least in part by electricity generated by a wind turbine.

13. The apparatus of claim 11, wherein said moving chain is powered at least in part by electricity generated by a renewable resource.

* * * * *